United States Patent [19]

Phillips

[11] 4,292,702

[45] Oct. 6, 1981

[54] SURGE DAMPENED WATER BED MATTRESS

[76] Inventor: Raymond M. Phillips, 5500 W. 83rd St., Los Angeles, Calif. 90045

[21] Appl. No.: 59,250

[22] Filed: Jul. 20, 1979

[51] Int. Cl.[3] ..... A47C 27/08

[52] U.S. Cl. ..... 5/451; 5/457; 137/574

[58] Field of Search ..... 5/451, 452, 455, 457, 5/458, 449, 448; 137/574, 576; 297/DIG. 3

[56] References Cited

U.S. PATENT DOCUMENTS

| | | | |
|---|---|---|---|
| 3,456,270 | 7/1969 | Weinstein et al. | 5/451 |
| 3,840.921 | 10/1974 | Labianco | 5/451 |
| 3,848,282 | 11/1974 | Viesturs | 5/462 |
| 4,152,796 | 5/1979 | Fogel | 5/457 |
| 4,167,795 | 9/1979 | Lambert, Jr. | 5/458 |
| 4,208,748 | 6/1980 | Lobach | 5/451 |
| 4,247,962 | 2/1981 | Hall | 5/451 |

*Primary Examiner*—Roy D. Frazier
*Assistant Examiner*—Alexander Grosz

[57] ABSTRACT

An elongate flotation mattress having horizontal top and bottom walls, vertical side and end walls, a plurality of vertical, laterally spaced, longitudinally extending partitions between the top and bottom walls and coextensive with the major central portion of the mattress and defining longitudinally extending fluid conducting tunnels; and a fluid medium slackly filling the mattress structure; the partitions are serpentine and are arranged whereby each tunnel defines a plurality of longitudinally spaced flow restricting venturi and circulating chambers between the venturi to slow and dampen surging and residual wave action of fluid when fluid within the mattress is displaced by forces directed onto the top wall; the mattress further includes apertured flow-controlling diaphragms at the ends of the tunnels.

7 Claims, 7 Drawing Figures

SURGE DAMPENED WATER BED MATTRESS

This invention relates to beds and is particularly concerned with an improved water bed or flotation mattress.

BACKGROUND OF THE INVENTION

An ordinary water bed of the type and/or class here concerned with comprises an upwardly opening rectangular frame structure including a flat horizontal mattress supporting platform and flat, vertical upwardly projecting side and end boards, with straight horizontal top edges about the perimeter of the platform, and a flotation mattress arranged within the frame structure in supported engagement on the platform and in retained engagement with the side and end boards about its perimeter. The frame structure is a fabricated structure of a rigid or semirigid material such as wood or polyurethane foam and the mattress is a simple bladder-like unit constructed of flexible material such as polyvinylchloride sheeting and is filled with a suitable liquid or gaseous fluid medium, such as water or air. Water filled flotation mattresses are constructed or formed to substantially correspond with the interior space defined by the frame structures and have or define normally flat horizontal body supporting top walls, flat horizontal bottom walls and normally flat vertical side and end walls. The bottom, side and end walls normally establish flat supported engagement with the platforms and the side and end boards of the bed frame structures with which they are related. The body supporting top walls normally occur on a horizontal plane substantially coincidental with the planes of the frame structures on which the upper edges of the side and end boards occur.

In practice, the vertical extent or depth of flotation mattresses, that is, the normal vertical pace or distance between the top and bottom walls and the resulting depth of the water within the mattresses is, for example, about 8" and is such that when the bodies of persons of maximum anticipated weight are engaged on and supported by the top walls of the mattresses and the top walls are urged or depressed downwardly thereby, displacing volumes of water or air within the mattress whereby the bodies are buoyantly supported, the top walls will not, under normal circumstances, continually engage and stop against or "bottom out" on the bottom walls and/or platforms of the beds.

Flotation mattresses of the character referred to above are fabricated of panels and/or pieces of plastic sheeting cut, folded and welded together in accordance with predetermined patterns and procedures. The patterns, procedures and fabricating techniques employed by different manufacturers of flotation mattresses vary widely, but in most instances, the resulting mattresses are essentially alike as regards their basic configuration and definable top, bottom and side walls, noted in the preceding.

A major objection or shortcoming found in water beds resides in the tendency of the water within the mattresses to surge and create continuing, diminishing wave actions when bodies are engaged on the mattresses and/or when bodies on the mattresses move or shift position. The noted surging and wave action is often times quite disturbing to persons on the mattresss and is such that some persons lying on such mattresses suffer motion sickness when surging and wave action is generated by the movement of their bodies or the bodies of others on the mattresses.

While the above noted surging and wave action generated in flotation mattresses in soothing and restful to some people, others cannot tolerate it. Accordingly, the attributes or water beds are the subject of some controversy which has had material adverse effects on the sale and use of such beds.

It has been determined that if the surging and/or wave action in water beds was eliminated or reduce to an extent that it was not longer a problem to be considered, many persons who cannot or will not tolerate the surging and wave action experienced in the use of present day water beds would find no objection to such beds and would purchase and adopt the use of such beds to gain the principal advantages afforded thereby, that is, the uniform, conforming and fluid body support such beds provide.

The prior art has long sought to eliminate or reduce surging and wave action in flotation mattresses by the placement of baffles within the mattresses to slow or dampen the movement of water within the mattresses. Such efforts have met with limited or questionable success and have often been so costly to put into practice that they are economically impractical.

Other attempts or means by the prior art to eliminate or reduce the surge and wave action in water beds has been directed to the establishment of mattress structures which are combinations of and constitute a compromise between flotation mattresses and conventional resilient foam plastic mattresses. In such structures, resilient foam plastic mattress pads of limited thickness are arranged within the bottom portions of common flotation mattresses or are arranged beneath special flotation mattresses of less than normal depth whereby the volume and depth of water in the resulting beds is reduced to an extent that surging and wave action is notably reduced.

Some combination mattress structures of the character referred to above have effectively reduced surging and wave action to acceptable levels but in doing so, they reduce the volume and depth of water so that full buoyant support of the bodies of persons engaged on the mattresses is not assured and is oftentimes unattainable. Such combination mattress structures are generally considered a compromise between true flotation mattresses and foam plastic mattresses and are considered to be of questionable value and effectiveness.

OBJECTS AND FEATURES OF THE INVENTION

An object of the present invention is to provide a novel improved flotation mattress including novel means to reduce surging and wave action to negligible levels.

It is an object and feature of the invention to provide a mattress of the general character referred to having flexible top, bottom, side and end walls and a plurality of laterally spaced parallel, vertical, flexible partitions between the top and bottom walls and spaced from the end walls, defining a plurality of laterally spaced longitudinally extending fluid mechanism conducting tunnels within the mattress and transverse medium conducting chambers at the opposite ends of and communicating with the tunnels, whereby the medium displaced upon depressing portions of the top wall, with resulting collapsing of portions of related tunnels, is caused to flow longitudinally out of the ends of the collapsing tunnels into and laterally through the chambers and thence longitudinally inward into other tunnels whereby the direction of movement of liquid medium within the mattress is changed and is slowed to materially reduce the generation of surge and subsequent wave action or motion within the mattress.

Another object of this invention is to provide a mattress of the character referred to above wherein the plurality of laterally spaced vertical partitions are undulating or serpentine in plan configuration and the undulations of adjacent serpentine partitions are longitudinally offset whereby the tunnels defined by each adjacent pair of partitions is characterized by a plurality of longitudinally spaced restrictive venturi throats and by intermediate enlarged circulating chambers between the throats whereby the rate of movement of a fluid medium longitudinally in and through the tunnel is slowed to effectively dampen or buffer surging in and through the mattress and buffer or stop subsequent wave action or motion therein.

Another object of my invention is to restrict motion through the use of vertical walls that make up each tunnel, that are substantially greater in height than that of the vertical dimension of the mattress. These vertical walls, because of their greater height, can oscillate or move freely inside the mattress, thus breaking up the wave form created by the back and forth motion of a moving liquid. This feature also gives a much greater degree of durability as the mattress surface can flex up and down without putting undue stress on the vertical tunnel walls.

Still another object of my invention is to provide a novel mattress structure of the general character referred to above which includes a fluid medium metering means at the ends of the tunnels to slow the movement or flow such a medium longitudinally outward therefrom and which allows for substantial free flow of the medium longitudinally inwardly therein so that the forced displacement of the medium from depressed or collapsed portions of the mattress is slowed and the acceptance of displaced medium into the other portions of the mattress is substantially unrestricted. Accordingly, the flow of previously displaced fluid medium from said other portions of the mattress back to the depressed portions of the mattress is slowed whereby surging and residual wave motion in the mattress is slowed and buffered to an extent that it creates no appreciable adverse effects.

Another object is that the tunnels, because they restrict the outward flow of the fluid medium, will provide a shock or energy absorbing function, thus providing an increased level of support consisting of an upward force that will retard the usual rapid collapsing of the mattress surface when a downward force is applied such as when a body sits, kneels, or lies on top of the mattress.

The foregoing and other objects and features of the invention will be fully understood from the following detailed description of preferred forms and embodiments of the invention throughout which description reference is made to the accompanying drawings.

DETAILED DESCRIPTION OF THE INVENTION

Figure 1:
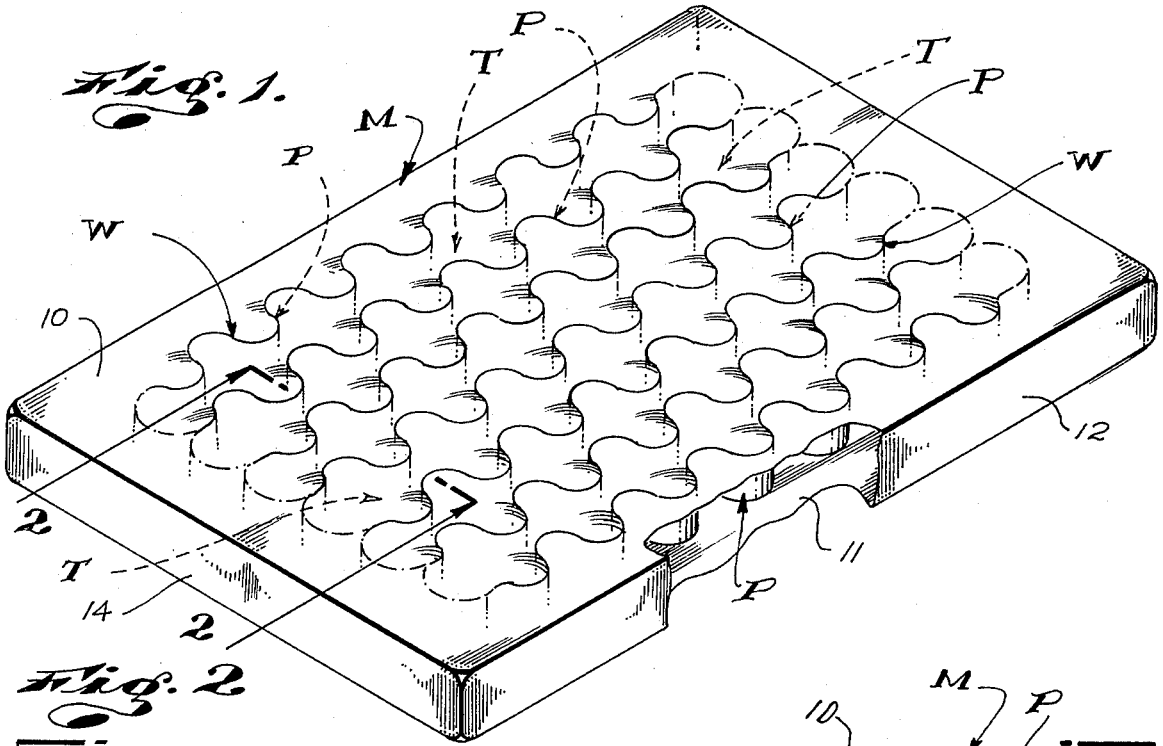
FIG. 1 is an isometric view of a flotation mattress embodying the invention with a portion broken away to show details of the invention.
Figure 2:
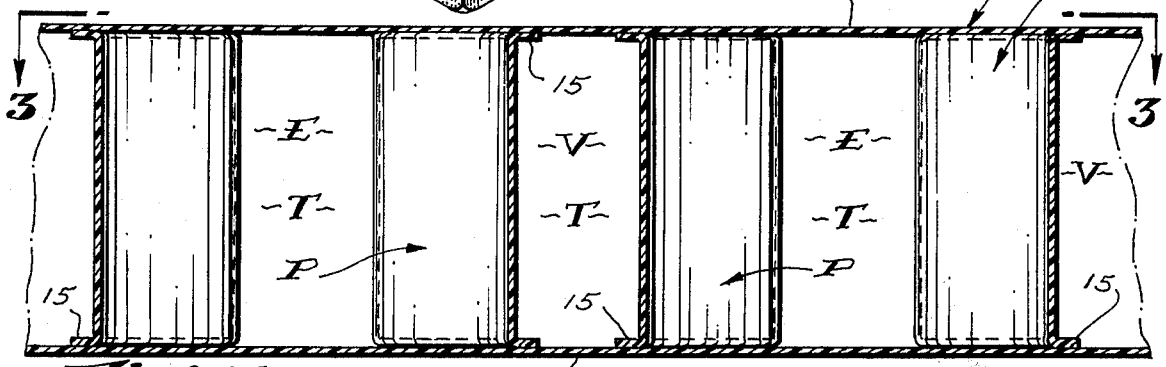
FIG. 2 is a sectional view taken substantially as indicated by line 2—2 on FIG. 1.
Figure 3:
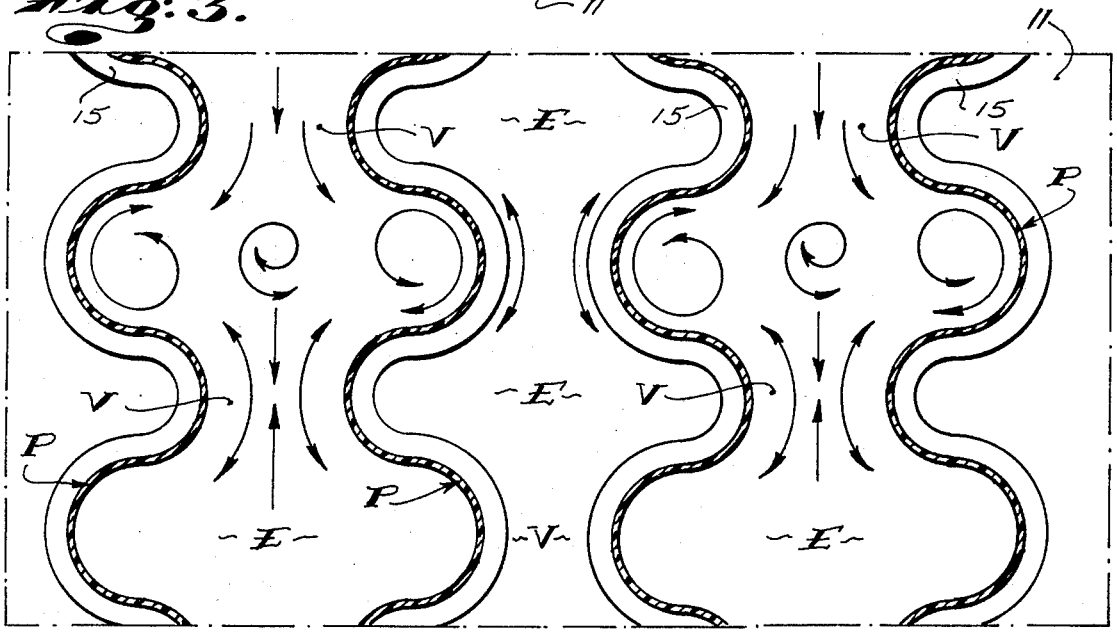
FIG. 3 is a sectional view taken substantially as indicated by line 3—3 on FIG. 2.

Referring to the drawings, the present invention first includes a basic mattress structure M. The mattress M is a flat horizontal unit of a flexible material such as polyvinylchloride sheeting. The mattress is rectangular in plan configuration and is characterized by flat, horizontal, vertically spaced top and bottom walls 10 and 11 and flat vertical side and end walls 12 and 14 about and extending between the perimeters of the top and bottom walls. The several walls are welded or otherwise integrally joined together to establish a sealed and essentially water-tight bladder-like structure.

The basic mattress structure can, for example, be made or established in accordance with the teachings in U.S. Pat. No. 4,025,975, for "Water Bed Mattress" issued to Raymond M. Phillips and William J. Pease on May 31, 1977.

The details of construction and the manufacturing techniques employed in the establishment of the basic mattress M described above can be varied widely without affecting the present invention. Accordingly, this disclosure need not and will not be unduly burdened by further illustrations and description of the basic mattress structure M.

In furtherance of the present invention, the interior of the basic mattress M shown in the drawings and briefly described above is divided to establish a plurality of longitudinally extending tunnels T in side by side relationship and defined by a plurality of laterally spaced, longitudinally extending vertical partitions P of flexible sheeting. The upper and lower edges of the partitions P join and are fixed to their related top and bottom walls 10 and 11 of the mattress M.

The partitions P and the tunnels T defined thereby are coextensive with the central portion of the mattress M and terminate short of or in limited predetermined spaced relationship from the end walls 14 of the mattress to cooperate therewith and define laterally extending fluid transfer or manifold chambers C which establish communication with and between the ends of the several tunnels T.

The chambers C can be limited in cross-sectional extent. For example, the chanbers C can be 8" by 9" or 72 square inches in cross-section.

In the preferred carrying out of the invention, the upper and lower edges of the longitudinally extending vertical partitions have horizontal flanges 15 which occur in flat engagement with the inside surfaces of the top and bottom walls 10 and 11 of the mattress and which are integrally joined with those walls by continuous welds W.

There are several methods and procedures for establishing and relating the partitions P in the mattress and with the top and bottom walls 10 and 11 thereof. One effective procedure is to arrange lengths of thin-walled tubular vinyl plastic stock on and about a plurality of elongate laterally spaced mandrels which are square in cross-section whereby the tubular shock on the mandrels is formed to define pairs of laterally spaced vertical panel portions and upper and lower web portions between said panel portions. The mandrels with the tube stock engaged thereon are arranged between the top and bottom walls 10 and 11 of the mattress M, from one end of the mattress (before that end of the mattress is sealed or closed) and the edge portions of the webs are welded to the walls 10 and 11, as shown at W in the drawings. Thereafter, the free portions of the webs, between the welds, and shown in slotted lines in FIG. 7 of the drawings, are cut away adjacent to the welds W and are disposed of. Thereafter, the open end of the mattress can be suitably closed and sealed either totally or partially.

Removal of the web portions as noted above is desirable since if the webs are left in the mattress structure, they establish spaces in which air is trapped and establish undesirable air pockets in the finished structure.

With the construction thus far described, it will be apparent that when the mattress is completed, is slackly filled with a fluid medium, such as water, and is arranged in supported and contained engagement in a related frame, and when a portion of the top wall 10 of the mattress is depressed as by the weight of a person's body engaged thereon, the portions of the tunnels T at and extending through the depressed portions of the mattress are collapsed and the medium or water therein is displaced and caused to flow axially and longitudinally outwardly therefrom into the chambers C. The medium or water displaced from tunnels into the chambers C displaces the medium or water in the chambers longitudinally inwardly into the other tunnels which are not acted upon by externally applied forces.

The friction generated between the fluid medium or water and the walls and partitions and by the change of direction of movement of the medium or water materially slows the movement of the medium or water and thereby slows or buffers any surge and/or residual motion in the medium or water.

The slowing of the flow and the buffering of surge and residual motion in the fluid medium afforded by the structure thus far described, while desirable, is rather limited and may be less than adequate.

To gain additional and adequate buffer action, the present invention provides one or a combination of two added flow limiting means for controlling and slowing the rate of movement of the fluid medium out of and into the tunnels T in the mattress.

One of the above noted added means comprises forming the tunnels T with longitudinally spaced flow restricting venturi V and intermediate enlarged, circulating chambers E whereby the movement of fluid longitudinally in the tunnels is greatly slowed.

The other of said added means is the provision of valve like flow metering means F at the opposite ends of the tunnels.

Both of the foregoing added means function to effect the rate at which displaced fluid medium can flow in and from the ends of the tunnels T, into the chambers C, the resulting rate at which displaced medium can be distributed to other tunnels of the construction, and the rate at which displaced medium can reverse direction of movement and seek to reestablish its original dispersement within the construction.

In carrying out this invention and to establish the above noted longitudinally spaced venturi V and intermediate turbulating chambers E in or longitudinally of the tunnels T, the partitions P are serpentine in plan configuration. The undulations of adjacent serpentine partitions are longitudinally offset so that the crests and the troughs in the opposing surfaces of adjacent partitons are aligned, laterally of the longitudinal axes of the tunnels. With the above formation and relationship of parts, it will be apparent that the opposing longitudinally spaced crests of the undulations of the partitions defining each tunnel T establish longitudinally spaced flow restricting venturi V in each tunnel and that the longitudinally spaced opposing troughs of the undulations of the partitions establish enlarged circulating chambers E between the venturi.

In practice, the lateral extent and flow capacity of the venturi V and of the chambers E can be varied as desired or as circumstances require. For the purpose of illustration, the chambers E are shown as being twice as wide and as having twice the flow capacity as the venturi V.

With the construction illustrated and described above, it will be apparent that the venturi V worked to slow the movement of displaced fluid medium from one chamber E to the other and the chambers E work to slow the flow of medium entering them from their related venturi. Medium flowing from the venturi V at high velocity into the chambers E establish eddy currents in the chambers E which result in considerable turbulence, friction loss and the expending of much energy. The constricting and accelerating of the medium entering and flowing through the venturi also generates friction losses and expends or dissipates energy. The cumulative work and dissipation of energy performed by the venturi V and the chambers E is substantial and effectively controls and slows the flow of medium longitudinally of the tunnels T to an extent that surging of the medium in the construction is buffered or dampened and residual motion is reduced to such an extent that surge and wave action is substantially insignificant in or during normal use of the mattress.

The flow metering means F provided by this invention, which means can be employed to slow the flow or movement of the fluid medium into and out of the ends of the tunnels T instead of or in combination with the above noted venturi and circulating chamber means, comprises flexible membranes or diaphragms 40 across the opposite ends of the tunnels, which membranes or diaphragms have flow metering apertures or slots 41 therein.

Figures 4, 5, 6, 7:
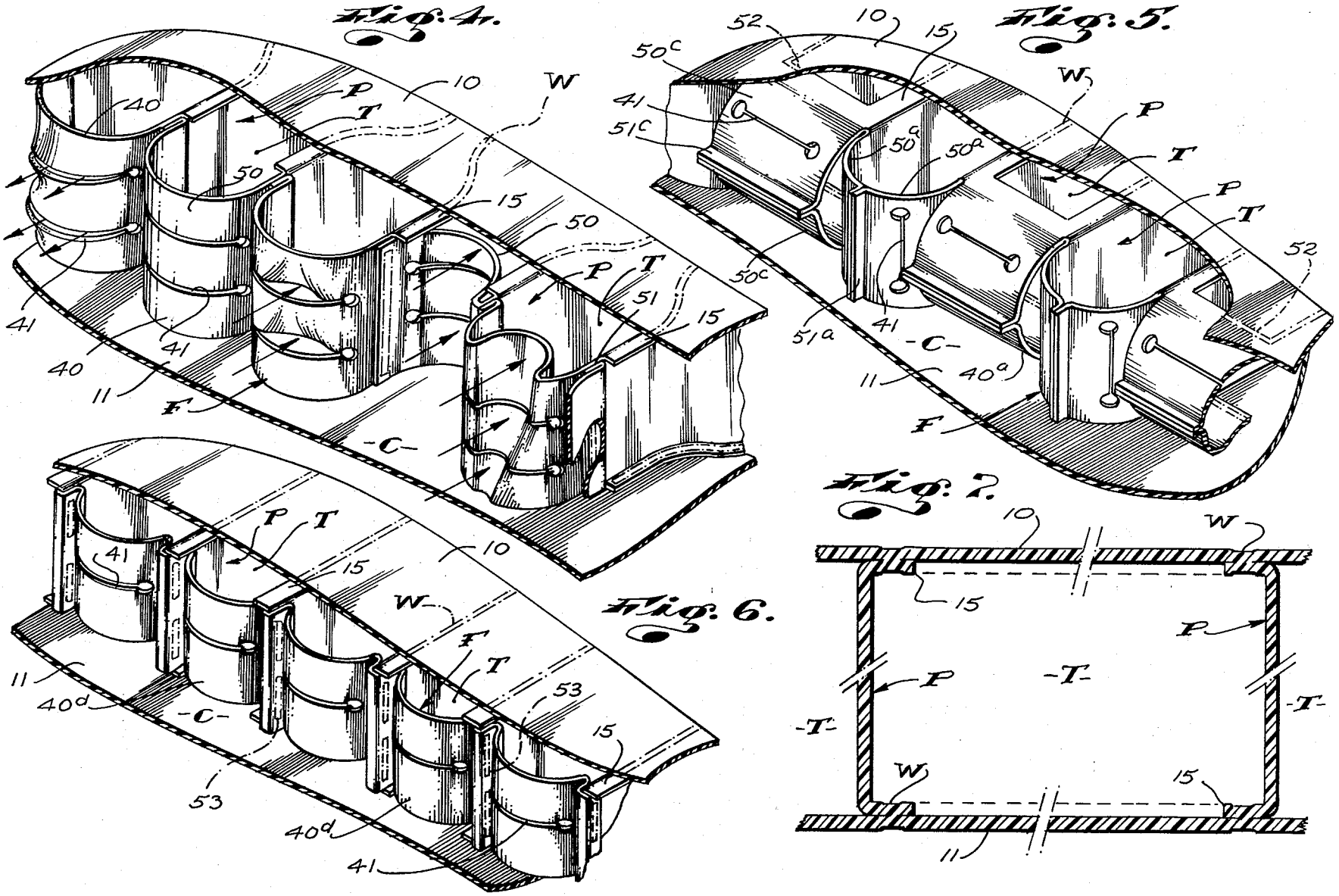
FIG. 4 is an isometric view of a portion of the structure that we provide.
FIG. 5 is a view similar to FIG. 4 showing another form of the invention.
FIG. 6 is an isometric view showing yet another form of the invention.
FIG. 7 is an enlarged sectional view showing details of the construction.

The diaphragms 40 can be established by longitudinally outwardly, laterally and thence longitudinally inwardly turned extensions 50 at the ends of each partition. The free end of the extension on each partition is welded or otherwise fixed to the related end of the next adjacent partition, as shown at 51 in FIG. 4 of the drawings. Alternatively, and as shown in FIG. 5 of the drawings, the diaphragms $\mathbf{40}^a$ at the ends of alternate or every other of the tunnels T are established by longitudinally outwardly and laterally turned extensions $\mathbf{50}^a$ at the ends of the partitions establishing those tunnels. The extensions $\mathbf{50}^a$ are joined at or across the central portions of the diaphragms as by welding and as shown at $\mathbf{51}^a$. The other or alternate diaphragms $\mathbf{40}^a$ in the form of the invention shown in FIG. 5 of the drawings are established by vertically and longitudinally inwardly turned upper and lower extensions $\mathbf{50}^c$ at the ends of the web portions of the tubular stock employed to establish the partitions P, as described above and which are joined at or across the centers of those diaphragms by welded seams or the like as indicated at 51$^c$ in FIG. 5 of the drawings.

The end portions of the extensions 50$^c$ adjacent the top and bottom walls 10 and 11 of the mattress are fixed or welded to those walls of the mattress as indicated at 52. The welds 52 are established before the web stock is removed, as previously described.

Still further, and as shown in FIG. 6 of the drawings, the diaphragms 40$^d$ can be established of an elongate vertical laterally extending strip of flexible material extending across the open ends of the several tunnels, at the opposite ends thereof, and welded or otherwise fixed to the ends of the several partitions by welds 53, substantially as shown in FIG. 6 of the drawings.

The several above noted and illustrated forms of the diaphragms, at the ends of the tunnels T, clearly illustrate that the diaphragms of the means F can be established in many different ways without materially affecting or departing from the spirit of this invention.

In the preferred carrying out of the invention, the flexible diaphragms at the ends of the tunnels are provided with one or more fluid conducting apertures or ports 41 through which fluid medium can be forced to flow.

The apertures or ports 41 are preferably elongated or slotted ports extending transverse the diaphragms and are such that they will open and allow for increased flow of the fluid medium therethrough as they are subjected to increased fluid pressures and to thereby serve as pressure release means. Accordingly, the ports function to relieve pressure of the fluid medium, upstream of the diaphragms, before it increases or reaches that point which is likely to rupture or otherwise damage the mattress structure.

Such opening of the slot-like ports 41 is effected by bending and/or deflection of the stock of the diaphragms about and defining the ports, under the fluid pressure acting thereon and as shown in FIG. 4 of the drawings.

Further, in the preferred carrying out of the invention, the ported diaphragms at the ends of the tunnels T are established of sufficient or excess sheet stock so that they are normally substantially slack as they extend across the ends of their related tunnels and are such that they are free to move axially inwardly and/or outwardly relative to the ends of the tunnels limited distances when initially acted upon by the fluid medium moving into or out of the tunnels, as shown in FIG. 4 of the drawings. Such slack and limited free movement of the diaphragms afford substantially free limited movement of medium in the mattress, upon initial movement of the medium therein by externally applied forces, before the diaphragms commence to perform their flow metering function. Otherwise stated, the noted slackness in the diaphragms of the means F described above and illustrated in FIG. 4 of the drawings imparts limited lost motion in and/or delayed metering action by the means F so that when movement of the medium in the mattress is initiated by externally applied forces on a portion thereof, the flow or movement of the medium in the mattress is first substantially unrestricted and allows the mattress to initially or first freely yield under the applied forces and to thereafter commence to limit and slow movement of the medium and to thereby buffer the flow and the resulting rate at which the mattress yields under the applied force.

In practice, the movement of the fluid medium into and out of the plurality of tunnels T is not uniform with respect to time with the result that the delay of the several diaphragms to commence to meter the movement of the medium is progressive over a notable period of time. With such a relationship and rule of action, the flow or movement of the medium is variable from a maximum flow, which allows for free conformation of the mattress with bodies moving into engagement therewith to diminish flow which dampens the surge of the mattress contents and subsequent motion and which slows the rate at which the mattress conforms with the bodies engaged thereon.

It is important that the means F not afford excessive restriction to the flow so that fluid medium in any portion of the mattress is not prevented from moving and dispersing throughout the remainder of the mattress and to create back pressures in any portion thereof which are likely to result in damage to the mattress structure.

While the foregoing sets sorth a preferred form of metering means F, it will be apparent that the diaphragms thereof can be such that they have little slack and afford little free movement. In such cases, the ports or apertures therein are formed or increased in number and/or spoke size so that substantial and sufficient flow is permitted through the diaphragm to prevent the establishment of excessive and damaging back pressures in the construction.

In the foregoing, attention has been devoted to the movement of fluid medium, such as water caused by and moving in advance of or away from portions of the mattress subjected to and depressed or collapsed by externally applied forces. It will be apparent that the controlled flow of the medium in and throughout the mattress, remote from the area of applied forces thereon is essentially the same as described in the foregoing. Still further, it will be apparent that when a body engaged on the mattress comes to rest and/or when a body on the mattress is removed therefrom and the forces causing depressing or collapsing of the mattress are removed, the medium in the mattress establishes reverse flow to reestablish equilibrium or its own level in the mattress. With the flow control means provided by the present invention, it will be apparent that such reverse flow in the mattress operates to slow or dampen surging therein and to buffer and dampen residual wave action in the same manner as set forth in the preceding.

In FIG. 4 of the drawings, the diaphragms 40 at the ends of certain of the tunnels T are shown acted upon by a fluid medium moving outwardly from those tunnels while the diaphragms 40, related to other of the tunnels T, are shown acted upon by the medium moving axially into the tunnels as might occur in normal use of the construction and which graphically illustrates the functioning of the construction described in the foregoing.

Having described only typical preferred forms and applications of the invention, we do not wish to be limited to the specific details herein set forth, but wish to reserve to ourselves any modifications and/or variations that may appear to those skilled in the art and which fall within the scope of the following claims:

Having described our invention, we claim:

1. A flotation mattress structure including an elongate bladder like envelope of flexible fluid medium impervious sheet material having normally flot horizontal top and bottom walls, vertical side and end walls about and extending between the perimeters of the top and bottom walls, a plurality of elongate vertical imperforate partitions of flexible sheet material in lateral spaced relationship within and extending longitudinally of the mattress with opposite ends spaced from the end walls and defining a plurality of laterally adjacent longitudinally extending tunnels and laterally extending transfer chambers at the ends of said communicating with the tunnels, a volume of fluid medium within and slackly filling the tunnels and chambers and flow restricting means to slow the flow rate of the medium longitudinally through and into and out of the ends of the tunnels when portions of the mattress are depressed by externally applied forces on the top wall thereof and when said externally applied forces are reduced and removed from the mattress whereby surging and residual wave motion of the medium in the mattress is slowed and buffered, said partitions being serpentine throughout their longitudinal extent across their mean vertical planes whereby the opposing surfaces of adjacent partitions define alternate crests and troughs throughout their longitudinal extent, the crests of adjacent partitions being laterally aligned to define longitudinally spaced venturi in the tunnels and the troughs of adjacent partitions being laterally aligned to define enlarged circulating chambers between the venturi in the tunnels whereby the flow of the medium longitudinally in the tunnels is restricted and slowed entering the venturi and is circulated in and its longidutinal movement is slowed in the circulating chambers between the venturi, said venturi and circulating chambers establishing said flow restricting means.

2. The flotation mattress structure set forth in claim 1 wherein the flow restricting means further include diaphragms of flexible sheet material across the opposite ends of the tunnels, said diaphragms having flow restrictive ports therein.

3. The flotation mattress structure set forth in claim 2 wherein the diaphragms are normally slack across the ends of their related tunnels whereby said diaphragms move freely a limited distance in advance of fluid medium moving into and out of the tunnels before they restrict movement of and commence to meter the flow of the medium into and out of the tunnels.

4. The flotation mattress structure set forth in claim 4 wherein the ports in the diaphragms at the ends of the tunnels are elongate slotted ports and the diaphragms stock about and defining the ports is yieldingly moved by fluid pressure acting on the diaphragms to enlarge the ports to allow increased flow therethrough and to thereby relieve fluid pressure acting on the diaphragms.

5. A flotation mattress structure including an elongate bladder like envelope of flexible fluid medium impervious sheet material having normally flat horizontal top and bottom walls, vertical side and end walls about and extending between the perimeters of the top and bottom walls, a plurality of elongate vertical imperforate partitions of flexible sheet material in lateral spaced substantially parallel relationship within and extending longitudinally of the mattress with opposite ends spaced from the end walls and defining a plurality of laterally adjacent longitudinally extending tunnels and laterally extending transfer chambers at the ends of and communicating with the tunnels, a volume of fluid medium within the slackly filling the tunnels and chambers and flow restricting means to slow the flow rate of the medium longitudinally through and into and out of the ends of the tunnels when portions of the mattress are depressed by externally applied forces on the top wall thereof and when said externally applied forces are reduced and removed from the mattress whereby surging and residual wave motion of the medium in the mattress is slowed and buffered; said flow means further including diaphragms of flexible sheet material across the opposite ends of the tunnels, said diaphragms having flow restrictive ports therein.

6. The flotation mattress structure set forth in claim 5 wherein the ports in the diaphragms at the ends of the tunnels are elongate slotted ports and the diaphragm stock about and defining the ports is yieldingly moved by fluid pressure acting on the diaphragms to enlarge the ports to allow increased flow therethrough and to thereby relieve fluid pressure acting on the diaphragms.

7. The flotation mattress structure set forth in claim 5 wherein the diaphragms are normally slack across the ends of their related tunnels whereby said diaphragms move freely a limited distance in advance of fluid medium moving into and out of the tunnels before they restrict movement of and commence to meter the flow of water into and out of the tunnels.

* * * * *